US011268296B2

(12) United States Patent
Hoogland

(10) Patent No.: US 11,268,296 B2
(45) Date of Patent: Mar. 8, 2022

(54) TOGGLE LATCH MECHANISM

(71) Applicant: B/E Aerospace, Inc., Winston-Salem, NC (US)

(72) Inventor: Frank Hoogland, Leusden (NL)

(73) Assignee: B/E Aerospace, Inc., Winston-Salem, NC (US)

( * ) Notice: Subject to any disclaimer, the term of this patent is extended or adjusted under 35 U.S.C. 154(b) by 217 days.

(21) Appl. No.: 16/777,970

(22) Filed: Jan. 31, 2020

(65) Prior Publication Data

US 2021/0238884 A1 Aug. 5, 2021

(51) Int. Cl.
*E05B 15/00* (2006.01)

(52) U.S. Cl.
CPC ..... *E05B 15/0086* (2013.01); *E05B 15/006* (2013.01)

(58) Field of Classification Search
CPC ..... Y10T 292/0839; E05B 15/0086; E05B 15/006; E05B 15/04; E05B 15/101; E05B 17/0037; E05B 2015/0496; Y10S 292/49; Y10S 292/37; Y10S 292/61; E05C 1/08
USPC ..... 292/1, 137, 138, 163, 164, 169, 173
See application file for complete search history.

(56) References Cited

U.S. PATENT DOCUMENTS 225,558 A 3/1880 Brooks et al.
719,087 A * 1/1903 Christensen ..... E05B 1/0038 292/168
1,705,706 A * 3/1929 Bartholomew ..... E05C 1/14 292/166
2,547,546 A * 4/1951 Stulpin ..... E05C 1/14 292/166
2,573,061 A * 10/1951 Raymond ..... E05B 83/30 70/81
2,798,752 A * 7/1957 Doll ..... C10B 25/12 292/260
2,804,329 A * 8/1957 Landis ..... E05C 1/14 292/170
3,406,589 A 10/1968 Gaber
3,979,571 A 9/1976 Van Benschoten
(Continued)

FOREIGN PATENT DOCUMENTS

DE 102015101108 A1 7/2016
GB 197257 A 5/1923
(Continued)

OTHER PUBLICATIONS

Extended Search Report for European Application No. 21154564.5 dated Jun. 15, 2021, 12 pages.

*Primary Examiner* — Kristina R Fulton
*Assistant Examiner* — Steven A Tullia
(74) *Attorney, Agent, or Firm* — Suiter Swantz pc llo

(57) ABSTRACT

A toggle latch device translates a first push and release of a button to a locking pin translation from retracted to extended from within a housing. A second push and release of the button reverses the locking pin translation from extended to retracted back within the housing. The latch button remains desirably flush with the housing after each push and release. The translation of the latch button and that of the locking pin is angularly displaced by 90 degrees allowing the toggle latch device to employ a unique lever system which includes a buckling spring combined with a reversing hat which forces the locking pin in each of extension and retraction.

14 Claims, 18 Drawing Sheets

(56) References Cited

U.S. PATENT DOCUMENTS 4,039,214 A * 8/1977 Arends ..... E05B 1/0038 292/336.3
4,404,436 A 9/1983 Ohba
4,687,237 A * 8/1987 Bisbing ..... E05C 19/02 292/78
5,346,266 A * 9/1994 Bisbing ..... E05B 17/0025 292/142
5,368,347 A * 11/1994 Holtman ..... E05B 65/006 292/1
5,450,737 A * 9/1995 Sasaki ..... E05B 35/008 70/346
5,551,737 A * 9/1996 Clavin ..... E05B 83/30 292/169
6,343,816 B1 * 2/2002 King ..... E05B 63/22 292/165
6,648,162 B1 * 11/2003 Wooderson ..... A47J 27/0813 220/203.27
7,179,012 B2 * 2/2007 Bedi ..... F16B 5/06 292/1
7,267,379 B2 * 9/2007 Rusiana ..... E05B 15/101 292/137
7,451,628 B1 * 11/2008 Kim ..... E05B 83/30 70/159
7,862,092 B2 * 1/2011 Jaktlund ..... E05B 9/08 292/301
8,398,127 B2 * 3/2013 Persiani ..... E05C 19/022 292/163
2001/0045114 A1 * 11/2001 Sokurenko ..... E05B 13/105 70/370
2003/0047951 A1 * 3/2003 Belchine, III ..... E05B 85/10 292/336.3
2004/0028449 A1 * 2/2004 Waguespack ..... B41J 29/54 400/679
2006/0103140 A1 * 5/2006 Bella ..... E05B 65/5223 292/95
2007/0003391 A1 * 1/2007 Stapulionis ..... F16B 21/165 411/348
2007/0029816 A1 * 2/2007 Chen ..... E05B 47/004 292/251.5
2008/0100068 A1 * 5/2008 Kim ..... E05C 1/10 292/163
2008/0202910 A1 * 8/2008 Lutzke ..... H01H 3/3031 200/400
2010/0244465 A1 * 9/2010 de Mola ..... E05B 83/16 292/164

FOREIGN PATENT DOCUMENTS

GB 1368537 A 9/1974
GB 2242223 A * 9/1991 ..... E05C 1/16
JP 2006002499 A * 1/2006 ..... E05C 5/00
KR 20020023614 A 3/2002
KR 101767400 B1 8/2017
WO WO-9918314 A1 * 4/1999 ..... E05C 19/02

* cited by examiner

TOGGLE LATCH MECHANISM

BACKGROUND

Traditional door locks may include a handle, a rotating latch, or knob to lock the traditional door. These external knobs may cause additional weight, cause a hazard for passersby, and may be prone to failure.

Many traditional appliances may employ rotary knobs with handles for the latching of a door. A handle or recess within a front surface of a food service door may cause buildup of undesirable food items within the recess causing a health hazard.

Locking devices incorporated within a door housing may be cost prohibitive requiring structure modifications to a housing to which the door may attach.

Therefore, a need remains for a system and related method which may overcome these limitations and provide a novel solution to a simple locking device operated via a single actuation of a button.

SUMMARY

In one aspect, embodiments of the inventive concepts disclosed herein are directed to a toggle latch device. The toggle latch device may include a housing having a Y axis and an X axis, the X axis normal to the Y axis. Within the housing, the toggle latch device may include a locking pin configured for an X axis translation within a pin conduit within the housing, the locking pin having a locked position extending from the housing and a retracted position within the housing, the locking pin having a locking end extendable from the housing and a slide end opposite the locking end within the housing.

The toggle latch device may include a button configured for a Y axis translation within a button conduit within the housing, the button having a flush position flush with the housing and an activation position within the housing, a motion of the button from the flush position to the activation position within the Y axis translation. Here, at least one button spring biased for extension of the button to the flush position may return the button to its flush position.

The toggle latch device may include a piston having a button end and a rod end, the button end rigidly coupled with the button, the piston limited to the Y axis translation within a piston conduit within the housing and a rod having a piston end and a crank end, the piston end rotationally coupled with the rod end of the piston via a wrist pin, the crank end configured with a rod spring housing.

The toggle latch device may include a crank having an arc end and a shaft end, the arc end rotationally coupled with the rod on the crank end of the rod via a crank pin, the shaft end rotationally coupled with the housing via a shaft, the crank configured for a crank rotation about the shaft. Here, the crank may have a crank axis aligning the shaft and the crank pin, the rod having a rod axis aligning the wrist pin and the crank pin;

The toggle latch device may include a slide 150 rigidly coupled with the locking pin, the slide having a crank pin extension channel 152, the slide configured for the X axis translation within a slide channel within the housing. Here, the crank pin 142 may be rotationally coupling each of the rod, the crank, and a crank pin extension 148 extending within the crank pin extension channel 152, the crank pin extension slidably coupled with the crank pin extension channel, the crank pin extension configured for the Y axis translation within the crank pin extension channel.

The toggle latch device may include a hat 180 rotatably coupled with the housing via a hat pin, the hat having a hat spring housing 182, the hat limited in rotation about the hat pin, the hat having a positive position 282 corresponding to the locking pin retracted position and a negative position 284 corresponding to the locking pin locked position.

The toggle latch device may include a buckling spring 170 having a fixed end and a hat end, the buckling spring rigidly coupled with the rod spring housing on the fixed end, the buckling spring including a knuckle 172 rigidly coupled with the hat end, the knuckle slidably coupled with and inserted within the hat spring housing, the knuckle having a positive force position 272 and a negative force position 274 within the hat housing, the buckling spring configured for asserting a buckling spring force on the crank end of the rod, the buckling spring force along the X axis and one of: a positive buckling spring force corresponding to the locking pin retracted position and a negative buckling spring force corresponding to the locking pin extended position.

In function, with the locking pin in the retracted position a first positive translation of the button causes a rotation of the crank aligning the crank axis with the Y axis positively translating the locking pin; and a first negative translation of the button allows the positive buckling spring force to force the arc end of the crank to positively comply with the positive buckling spring force positively translating the locking pin to the locked position causing the knuckle to slide to the negative force position, the knuckle causing the hat to rotate to the negative position.

Further, a second positive translation of the button causes the rotation of the crank aligning the crank axis with the Y axis negatively translating the locking pin and a second negative translation of the button allows the negative buckling spring force to force the arc end of the crank to negative comply with the negative buckling spring force negatively translating the locking pin to the retracted position causing the knuckle to slide to the positive force position, the knuckle causing the hat to rotate to the positive position.

A further embodiment of the inventive concepts disclosed herein may include a toggle latch device. The toggle latch device may include a button means for actuating the toggle latch device and a crank means for converting a Y axis translation to an X axis translation. Also, the toggle latch device may include a locking means for locking a door. Here, a first actuation and release of the button means in the Y axis translation converts to a positive translation of the locking means in the X axis translation from a retracted state to an extended state, and a second actuation and release of the button means in the Y axis translation converts to a negative translation of the locking means in the X axis translation from the extended state to the retracted state.

It is to be understood that both the foregoing general description and the following detailed description are exemplary and explanatory only and are not necessarily restrictive of the inventive concepts as claimed. The accompanying drawings, which are incorporated in and constitute a part of the specification, illustrate embodiments of the inventive concepts and together with the general description, serve to explain the principles of the inventive concepts disclosed herein.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings in which.

DETAILED DESCRIPTION OF EXEMPLARY EMBODIMENTS

Figure 1A:
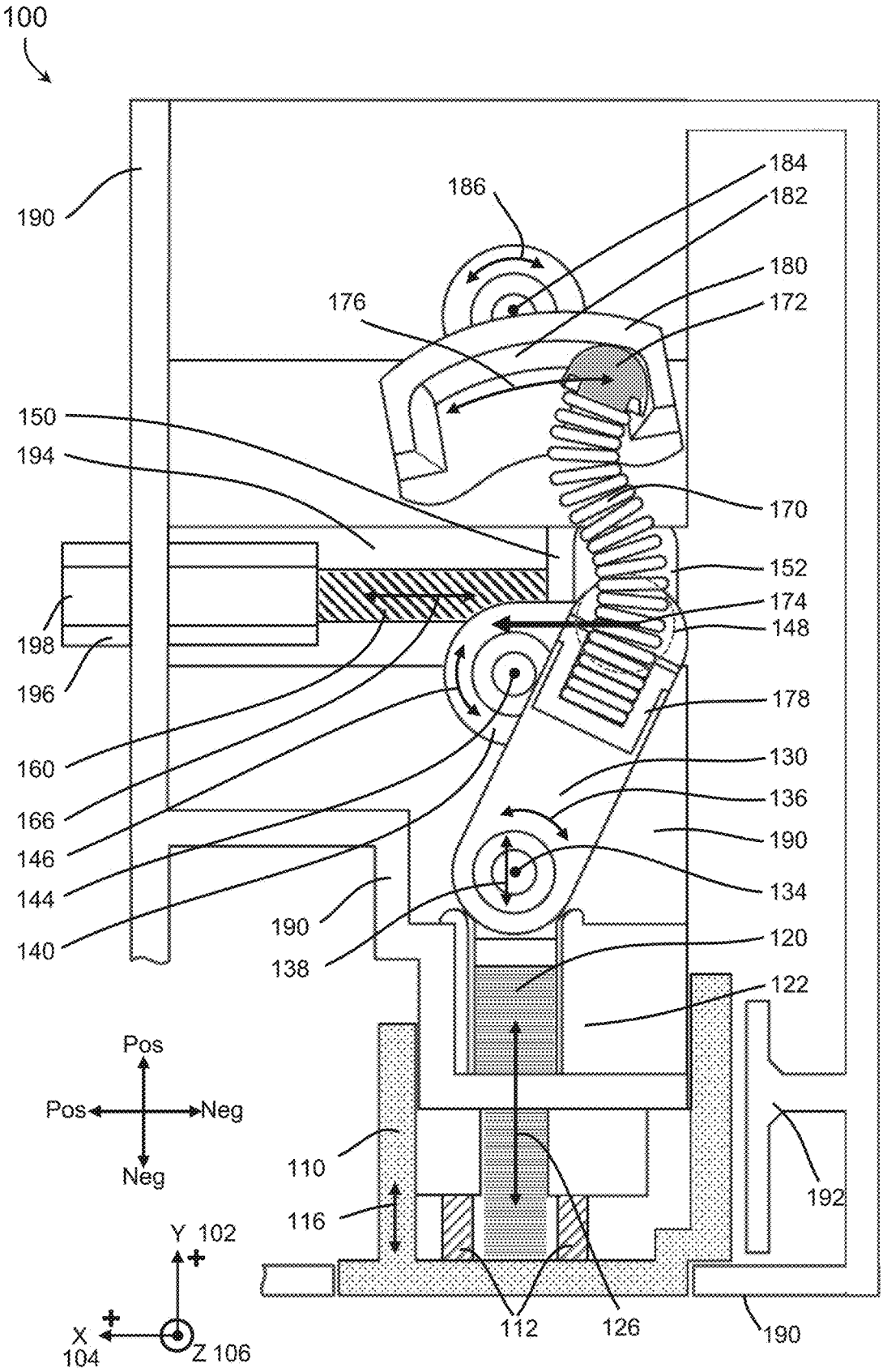
FIGS. 1A-1E are diagrams of a toggle latch device in locking pin extension in accordance with an embodiment of the inventive concepts disclosed herein.
Figure 1B:
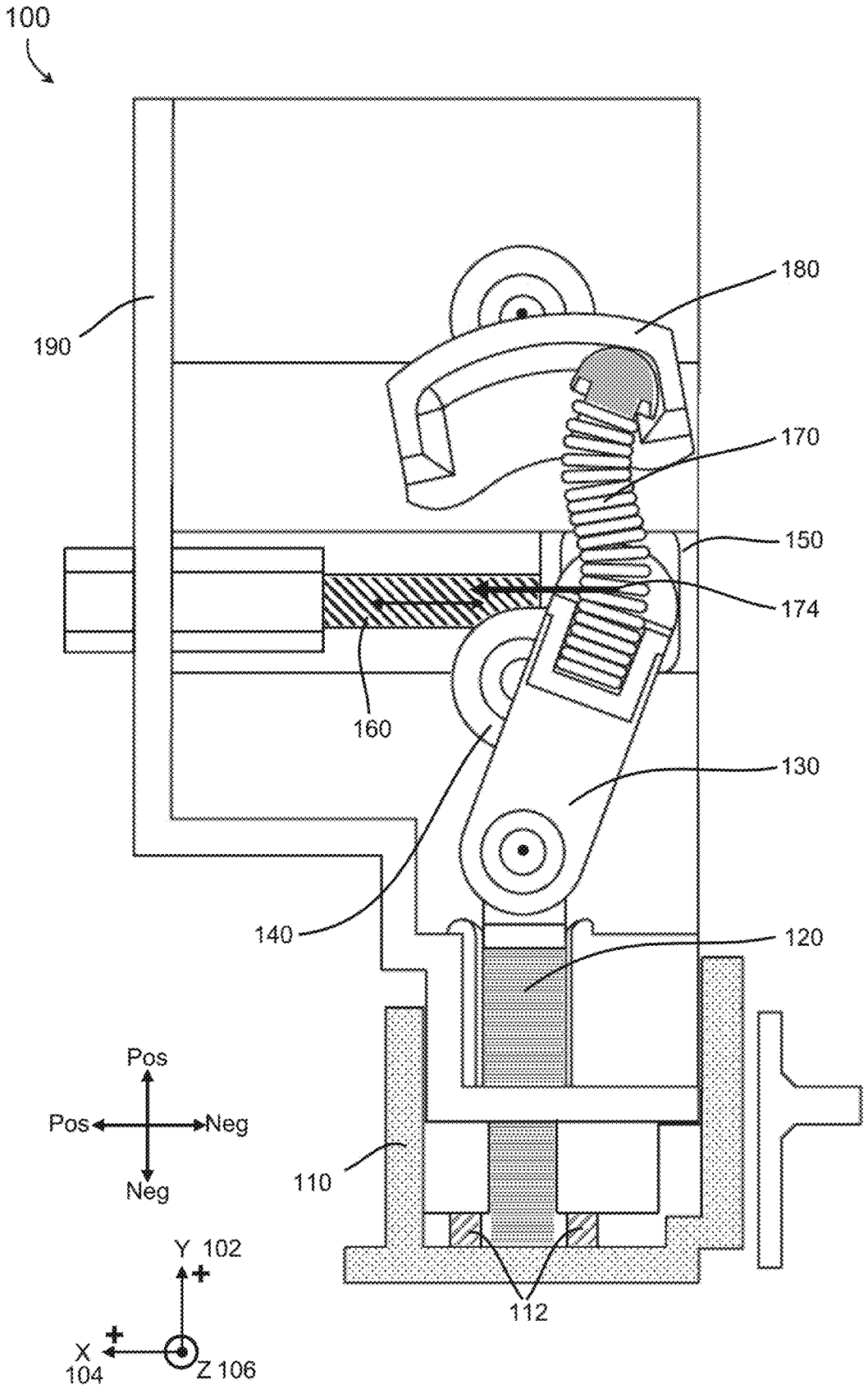

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, thus "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Overview

Broadly, embodiments of the inventive concepts disclosed herein are directed to a toggle latch device which functions to translate a first push and release of a button to a locking pin translation from retracted to extended from within a housing. A second push and release of the button reverses the locking pin translation from extended to retracted back within the housing. The latch button remains desirably flush with the housing after each push and release. The translation of the latch button and that of the locking pin is angularly displaced by 90 degrees allowing the toggle latch device to employ a unique lever system which includes a buckling spring combined with a reversing hat which forces the locking pin in each of extension and retraction. As ease of use may be desirable, a user with physical and/or mental challenges may find particular usefulness of the toggle latch device. Alternate embodiments (e.g., button size, linear displacement) of the toggle latch device may find successful incorporation within additional types of systems

REFERENCE CHART

| | |
|---|---|
| 100 | Toggle Latch Device |
| 102 | Y Axis |
| 104 | X Axis |
| 106 | Z Axis |
| 110 | Button |
| 112 | Button Spring |
| 116 | Button Translation (Y) |
| 120 | Piston |
| 122 | Piston Conduit |
| 126 | Piston Translation (Y) |
| 130 | Rod |
| 134 | Wrist Pin |
| 136 | Rod Rotation |
| 138 | Wrist Pin Translation (Y) |
| 140 | Crank |
| 142 | Crank Pin |
| 144 | Crank Shaft |
| 146 | Crank Rotation |
| 148 | Crank Pin Extension |
| 150 | Slide |
| 152 | Crank Pin Extension Channel |
| 156 | Crank Pin Extension Motion within Channel |
| 160 | Locking Pin |
| 166 | Locking Pin Translation (X) |
| 170 | Buckling Spring |
| 172 | Buckling Spring Knuckle |
| 174 | Buckling Spring Force |
| 176 | Knuckle Translation (x) |
| 178 | Rod Spring Housing |

-continued

| REFERENCE CHART | |
|---|---|
| 180 | Hat |
| 182 | Hat Spring Housing |
| 184 | Hat Pin |
| 186 | Hat Rotation |
| 190 | Housing |
| 192 | Button Conduit |
| 194 | Slide Channel |
| 196 | Pin Housing |
| 198 | Locking Pin Conduit |
| 230 | Rod Axis |
| 240 | Crank Axis |
| 262 | Locking End |
| 264 | Coupling End |
| 272 | Knuckle Positive Force Position |
| 274 | Knuckle Negative Force Position |
| 276 | Spring Hat End |
| 278 | Spring Fixed End |
| 282 | Hat Positive Position |
| 284 | Hat Negative Position |
| 326 | Piston Rod End |
| 330 | Rod Angular Travel |
| 332 | Rod Rotation from Y |
| 336 | Rod Crank End |
| 338 | Rod Piston End |
| 342 | Crank Pin Arc |
| 344 | Crank Angular Travel |
| 346 | Crank Arc End |
| 348 | Crank Shaft End |
| 500 | Enclosed Spring Housings |
| 600 | Bottom View |
| 700 | Perspective View |

FIG. 1A-4

Referring generally to FIGS. 1A-4, diagrams of a toggle latch device 100 in locking pin extension and retraction in accordance with some embodiments of the inventive concepts disclosed herein are shown. For reference herein, a housing 190 may include a Y Axis 102, an X Axis 104 normal to the Y axis, and a Z Axis 106 normal to each of the X and Y axes may be helpful in describing the orientation and movements of the various elements.

Generally, the toggle latch device may function to convert a Y axis translation of a first push and release of a button 110 into an X axis translation of a locking pin 160 from a retracted position to an extended position. Here, the first push and release of the button 110, enables the toggle latch device 100 to extend the locking pin 160 to an extended position thereby extending the locking pin from the housing 190 enabling a lock of, for example, a door. Additionally, a second push and release of the button 110 has the opposite effect on the locking pin 160 translating the locking pin from the extended position to a retracted position within the housing 190.

As used herein, a positive Y axis 102 translation may be indicated by the reference arrow in FIG. 1A with the arrow indicating the positive (Pos) direction while a negative (Neg) translation may be opposite of the positive. Similarly, a positive and negative translation in the X axis 104 may be indicated by the reference arrows aside the Pos and Neg indication.

As indicated herein, each shape shown in the figures may be an exemplary representation of a function of each element. Additional shapes and functions thereof may fall directly within the scope of the inventive concepts disclosed herein.

A series view of FIGS. 1A through 1E may indicate an extension sequence of the locking pin 160 while a series view of FIGS. 2A through 2D may illustrate a retraction of the locking pin 160. FIGS. 3A-3E may detail angles of rotation of some of the elements while FIG. 4 may detail a side view of some of the elements. In reference to FIGS. 1-4, the embodiments of the inventive concepts of the toggle latch device 100 may be detailed.

Referring to FIG. 1A, in one embodiment of the inventive concepts disclosed herein, the locking pin 160 may be configured for both positive and negative X axis translation 166 within a pin conduit 198 within the housing 190. The locking pin 160 may have a locking end 262 and an opposite coupling end 264. Additionally, a pin housing 196 may aid in structural support of the locking pin 160. Here, the locking pin 160 may have a locked position extending positively from the housing 190 and a retracted position negatively within the housing 190. The locking pin 160 having a locking end which extends from the housing 190 and a slide end opposite the locking end within the housing 190.

In one embodiment of the inventive concepts disclosed herein, the button 110 may be configured for positive and negative Y axis translation 116 within a button conduit 192 within the housing 190. The button 110 may have a flush position even with or flush with the housing 190 and an activation position positive along the Y axis within the housing. The desirable flush position of the button 110 may prevent foreign matter from collecting within a button recess. Here, as the button 110 may rest even with the housing, little foreign matter may collect around the button 110 enabling continuous button 110 operation without obstacle.

In one embodiment of the inventive concepts disclosed herein, the motion of the button 110 from the flush position to the activation position is positive Y axis translation while the motion from the activation to the flush position is negative Y axis translation. To ensure the button 110 remains in the flush position when not in use, the toggle latch device 100 may include one or more button springs 112 biased for extension of the button to the flush position.

In one embodiment of the inventive concepts disclosed herein, the toggle latch device 100 may include a piston 120 having a button end and a rod end 326 (see FIG. 4), the button end rigidly coupled with the button. Here as well, the piston 120 may be limited to the Y axis translation 126 within a piston conduit 122 within the housing 190. Coupled with the rod end 326 of the piston 120, a rod 130 may have a piston end 338 and a crank end 336, the piston end 338 rotationally coupled with the rod end of the piston via a wrist pin 134 while the crank end 336 may be configured with a rod spring housing 178 functional to receive and secure a buckling spring 170 (below). The rod 130 may be configured for rod rotation 136 about the wrist pin 134 as well as Y axis translation with the wrist pin 134.

Figure 3A:
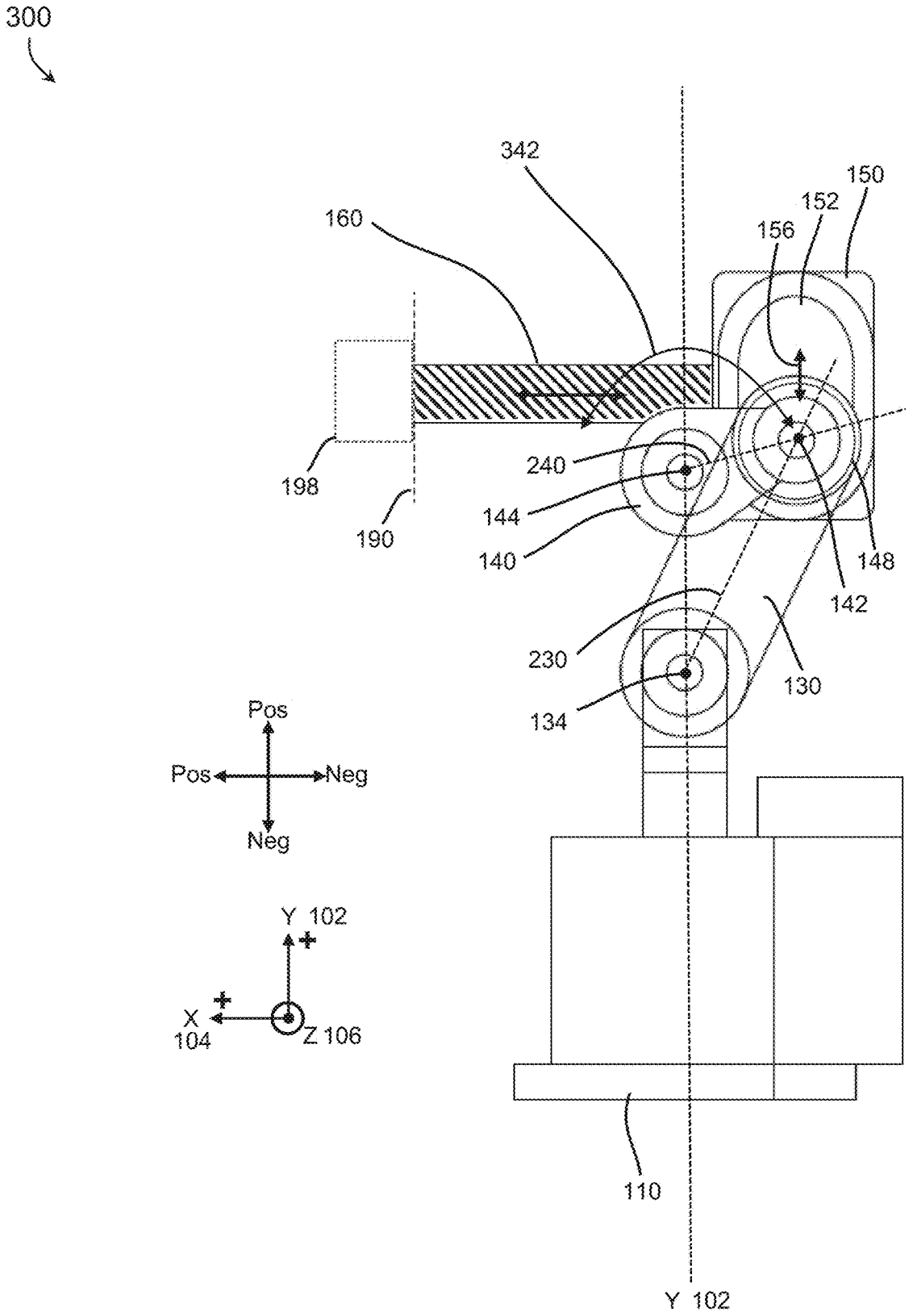
FIGS. 3A-3E are diagrams of angles of motion exemplary of an embodiment of the inventive concepts disclosed herein.
Figure 3B:
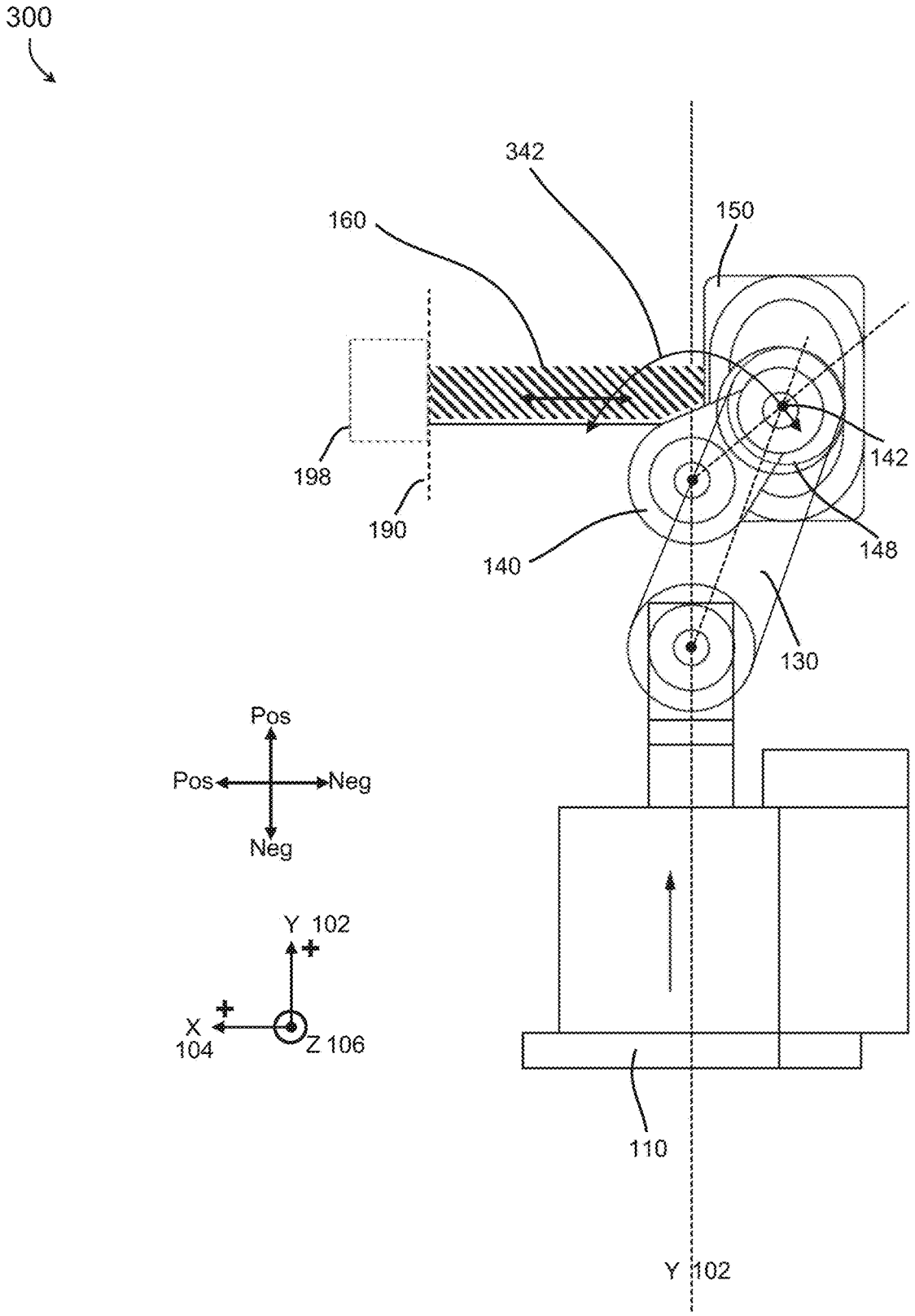
Figure 3C:
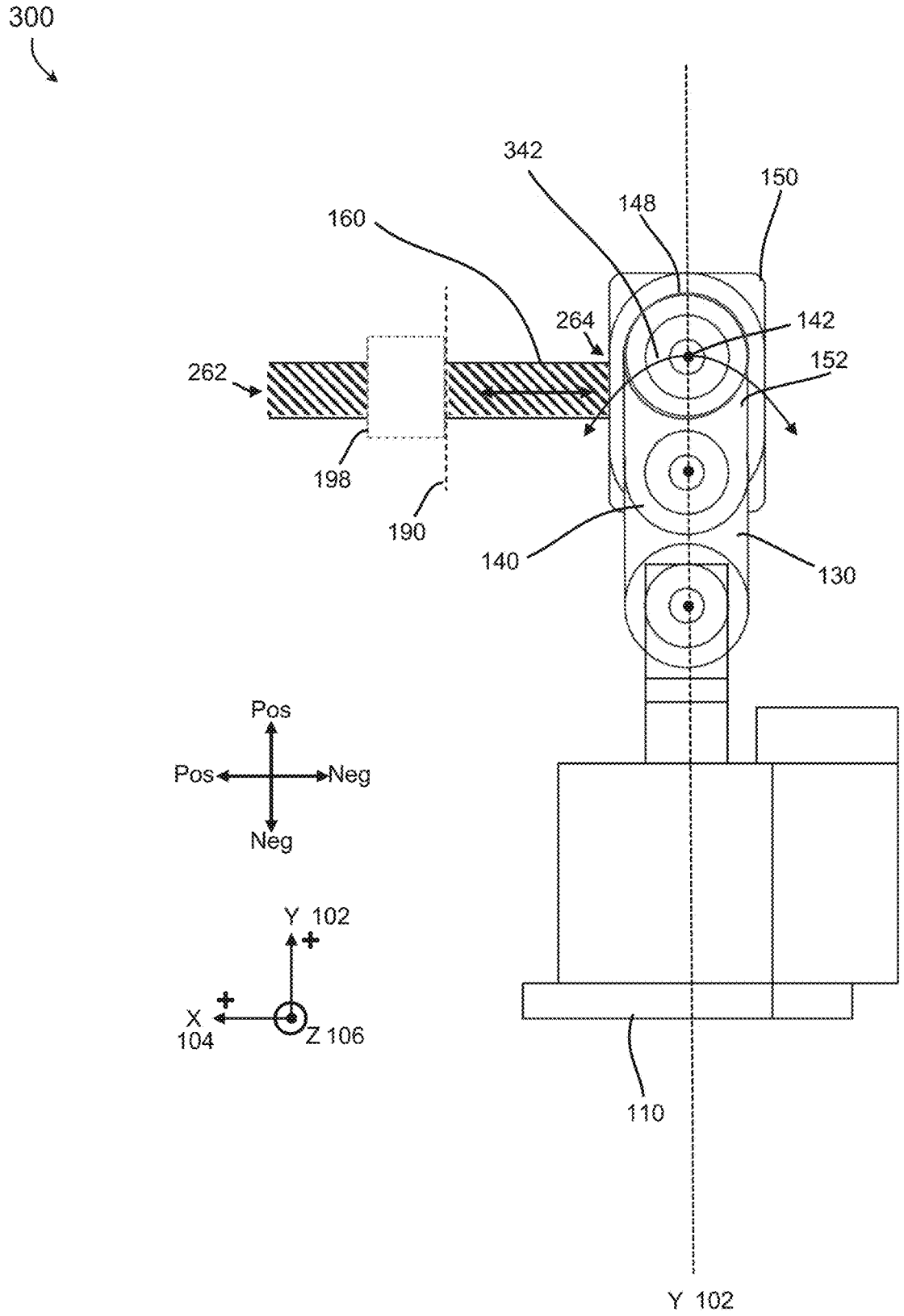
Figure 3D:
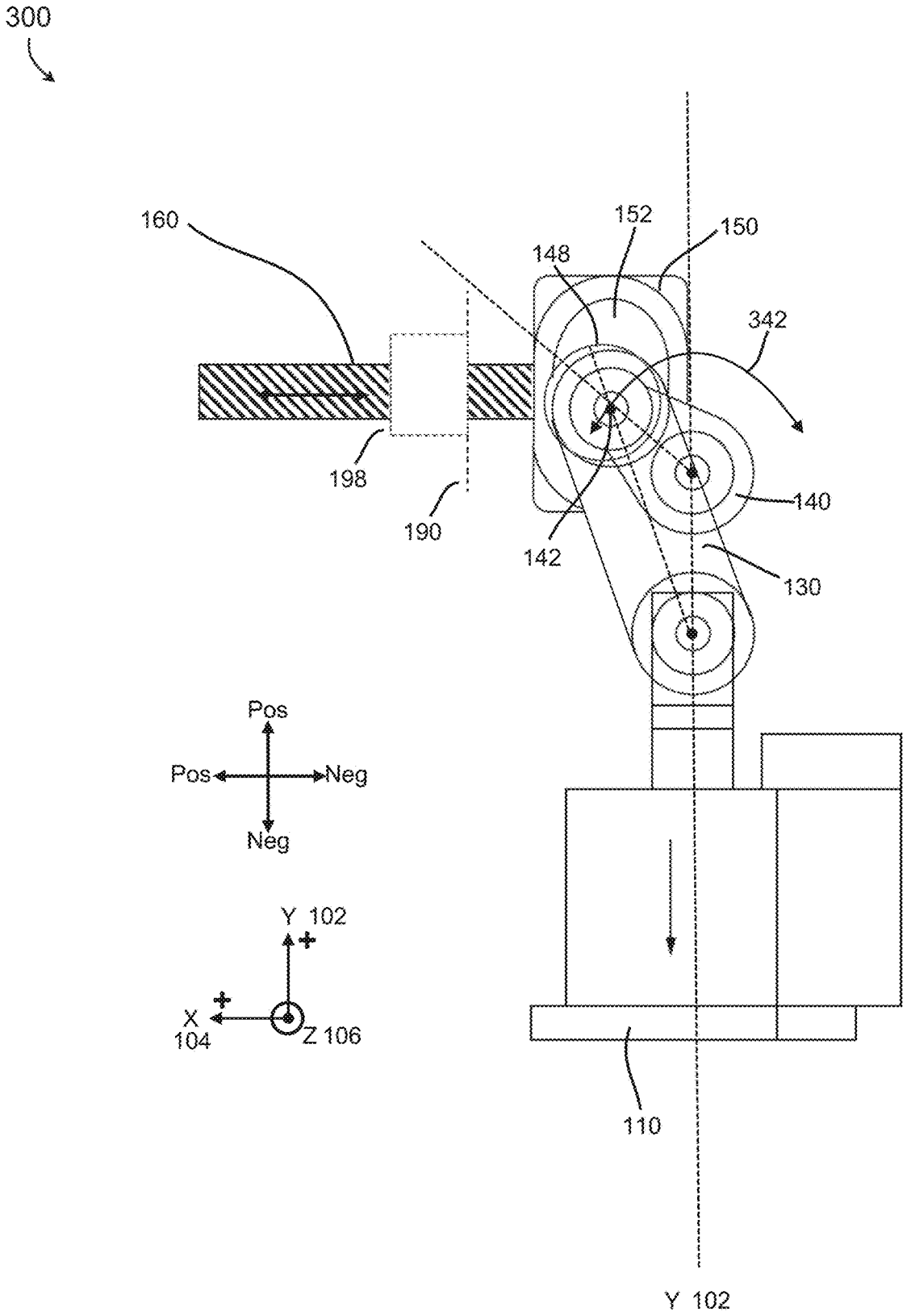
Figure 4:
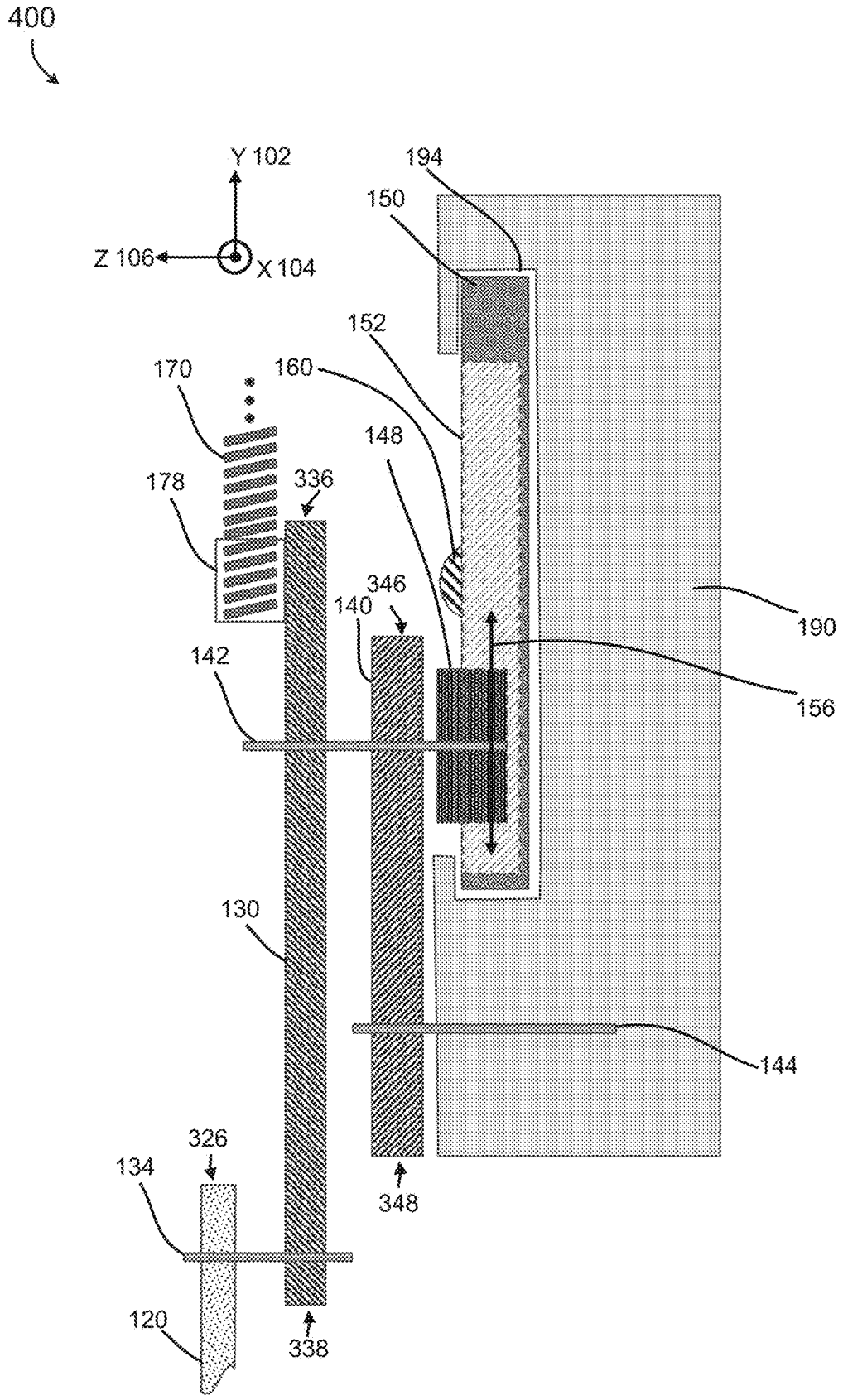
FIG. 4 is a diagram of a side view along the X axis exemplary of one embodiment of the inventive concepts disclosed herein.

In one embodiment of the inventive concepts disclosed herein, the toggle latch device 100 may include a crank 140 having an arc end 346 and a shaft end 348, the arc end 346 rotationally coupled with the rod 130 on the rod crank end 336 via a crank pin 142 (best seen in FIGS. 4, 3A). Here, the crank shaft end 348 may rotationally couple with the housing 190 via a shaft 144. Here of note, the crank 140 may be configured for a crank rotation 146 about the shaft 144 while the shaft 144 may be fixed to the housing 190. The crank 140 may have a crank axis 240 (FIG. 3A) which aligns with the shaft 144 and the crank pin 142. Similarly, the rod 130 may have a rod axis 230 (FIG. 3A) which aligns with the wrist pin 134 and the crank pin 142.

In one embodiment of the inventive concepts disclosed herein, the crank and the slide may be configured where four times the Y axis translation of the button 110 is approximately equal to the X axis translation of the locking pin 160. For example, one approximate Y axis translation of the button 110 may be four mm positive and similarly four mm negative enabling the locking pin 160 to move in the X axis translation by approximately 15 mm. In embodiments, additional linear displacement relationships between the Y axis translations of the button 110 and the X axis translation of the locking pin 160 may be desirable.

In one embodiment of the inventive concepts disclosed herein, the toggle latch device 100 may include a slide 150 may be rigidly coupled with the locking pin 160. The slide 150 and the locking pin 160 may move as one within the X axis translation. The slide 150 may be fitted with a crank pin extension channel 152 which may be configured for slidably receiving a crank pin extension 148 (FIGS. 3A, 4).

With reference to FIGS. 3A-3E, the crank pin extension 148 (and crank pin 142) may move in each of the Y 102 and X 104 axes represented by a crank pin arc 342. With the locking pin 160 retracted, the crank 140 acts on the crank pin extension 148 initially causing the crank pin extension 148 to translate positively in the Y axis 102. However, as the crank continues to rotate, the crank 140 causes the crank pin extension 148 (and slide 150 with attached locking pin 160) to translate in the X axis 104 as well. With the crank axis aligned with the Y axis, the crank pin extension 148 may translate within the X axis. As the crank 140 continues to rotate, the crank pin extension 148 may translate negatively within the Y axis 102.

Figure 3E:
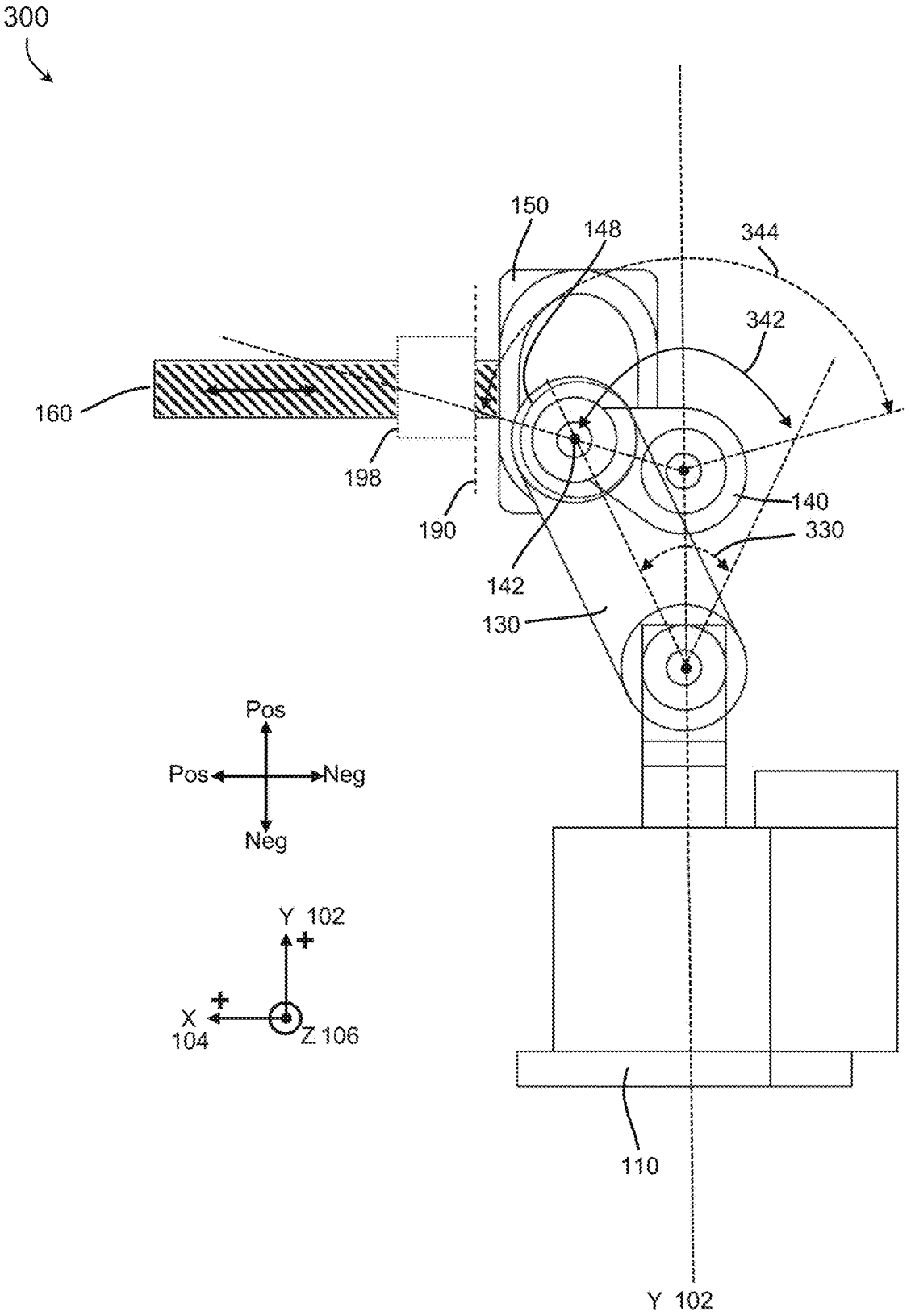

FIG. 3E may detail each angular displacement of each of the rod 130 and the crank 140. A rod angular displacement 330 may indicate rod 130 travel and exemplary limits thereof. A crank angular displacement 344 may indicate an angular displacement of the crank 140 as the toggle latch device 100 may function.

Here, the slide 150 may be configured only for the X axis translation within a slide channel 194 within the housing 190 while the crank pin extension 148 is limited to a crank pin extension motion 156 within the crank pin extension channel 152 sliding within the Y axis 102 of the crank pin extension channel 152. The combination of the slide motion within the X and the crank pin extension within the Y may produce the crank pin arc 342. In embodiments, the crank pin 142 may rotationally couple each of the rod 130, the crank 140, and the crank pin extension 148 which extends within and slidably couples with the crank pin extension channel 152 within the slide 150. In embodiments, a size of the crank pin extension 148 may be slightly smaller than that of the crank pin extension channel 152 and configured for the Y axis translation within the crank pin extension channel 152.

In one embodiment of the inventive concepts disclosed herein, the toggle latch device 100 may include a hat 180 rotatably coupled with the housing 190 via a hat pin 184. The hat may include a hat spring housing 182 configured for slidably receiving a knuckle 172 (below). Here, the hat 180 may be limited in a hat rotation 186 about the hat pin dependent on distances required between the hat 180 and the locking pin 160. Contemplated herein, a more distant hat 180 from the locking pin 160 may require a greater hat rotation 186 than would a shorter distance. Here, the hat 180 may have a positive position 282 (FIG. 1D) corresponding to the locking pin 160 retracted position and a negative position 284 (FIG. 1E) corresponding to the locking pin 160 locked position (extended).

In one embodiment of the inventive concepts disclosed herein, the hat 180 may maintain a present position (positive or negative) until the locking pin reaches a position approximately equal with each of the retracted position (negative) and the extended position (positive). For example, as the locking pin 160 reaches the locked position, the hat 180 may rotate from the hat positive position 282 to the hat negative position 284. The hat 180 then remains in the hat negative position 284 while the pin remains in the locked position. Conversely, as the button 110 is actuated, the locking pin 160 begins to move from the locked position to the retracted position and the hat remains in the hat negative position 284 to enable to buckling spring 170 to provide the negative buckling spring force 174 until the locking pin 160 approximately reaches the retracted position. At this point, the hat 170 may rotate from the hat negative position 284 back to the hat positive position 282 to be ready for another extension of the locking pin 160.

In one embodiment of the inventive concepts disclosed herein, the toggle latch device 100 may include the buckling spring 170 which may have a fixed end 278 (negative Y) and a hat end 276 (positive Y). Here, the buckling spring 170 may be rigidly coupled with the rod spring housing 178 on the fixed end. The buckling spring 170 may also include the knuckle 172 rigidly coupled with the hat end, the knuckle slidably coupled with and inserted within the hat spring housing 182. Contemplated herein, each of the knuckle 172 and the hat spring housing 182 may be coated with a material which may reduce friction allowing the knuckle 172 to freely translate 176 (slide) within the hat spring housing 182. Each of the combination of the materials used (that come into contact with each other) may be specifically configured to have as little friction as possible with each other.

Figure 1C:
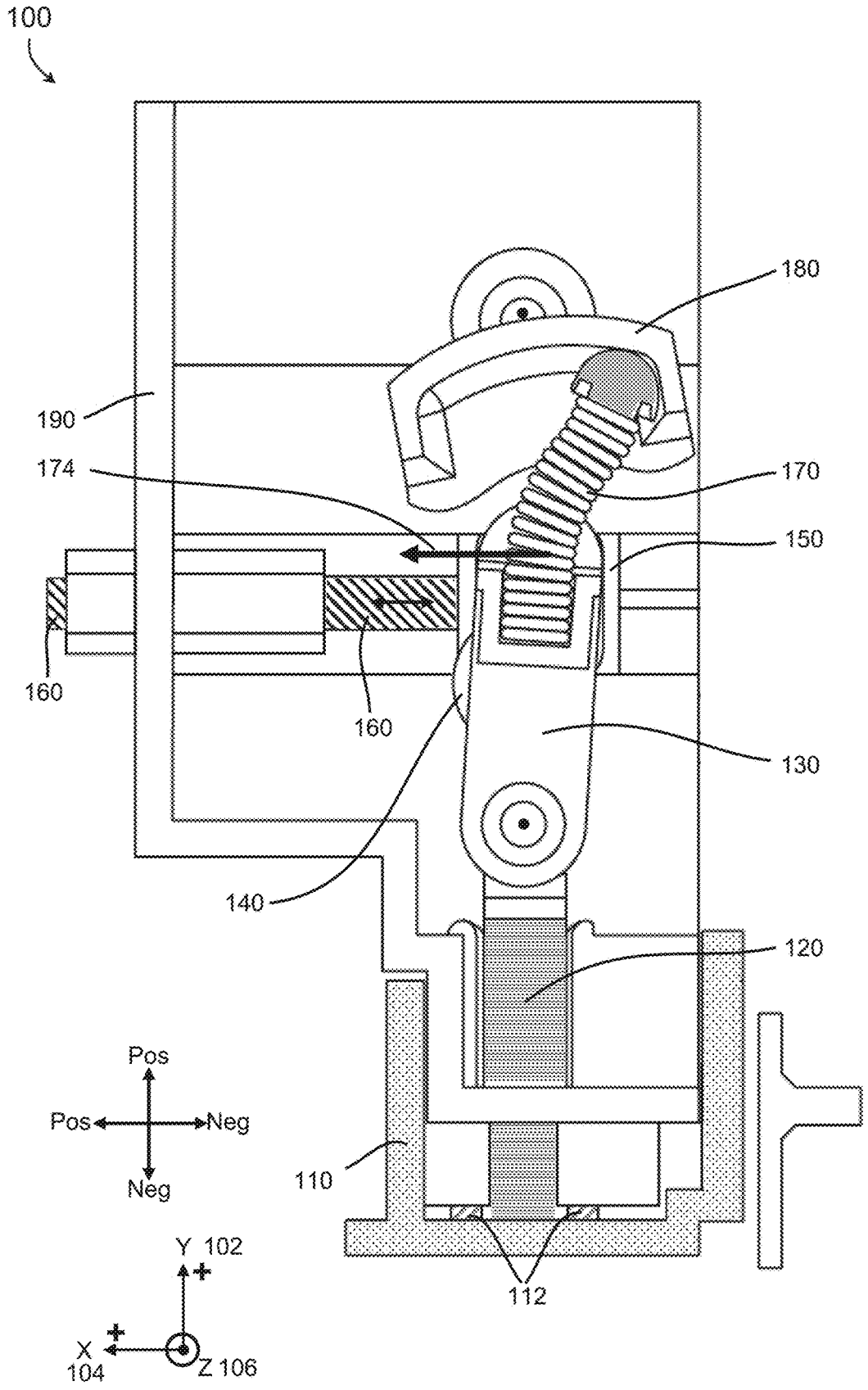
Figure 1D:
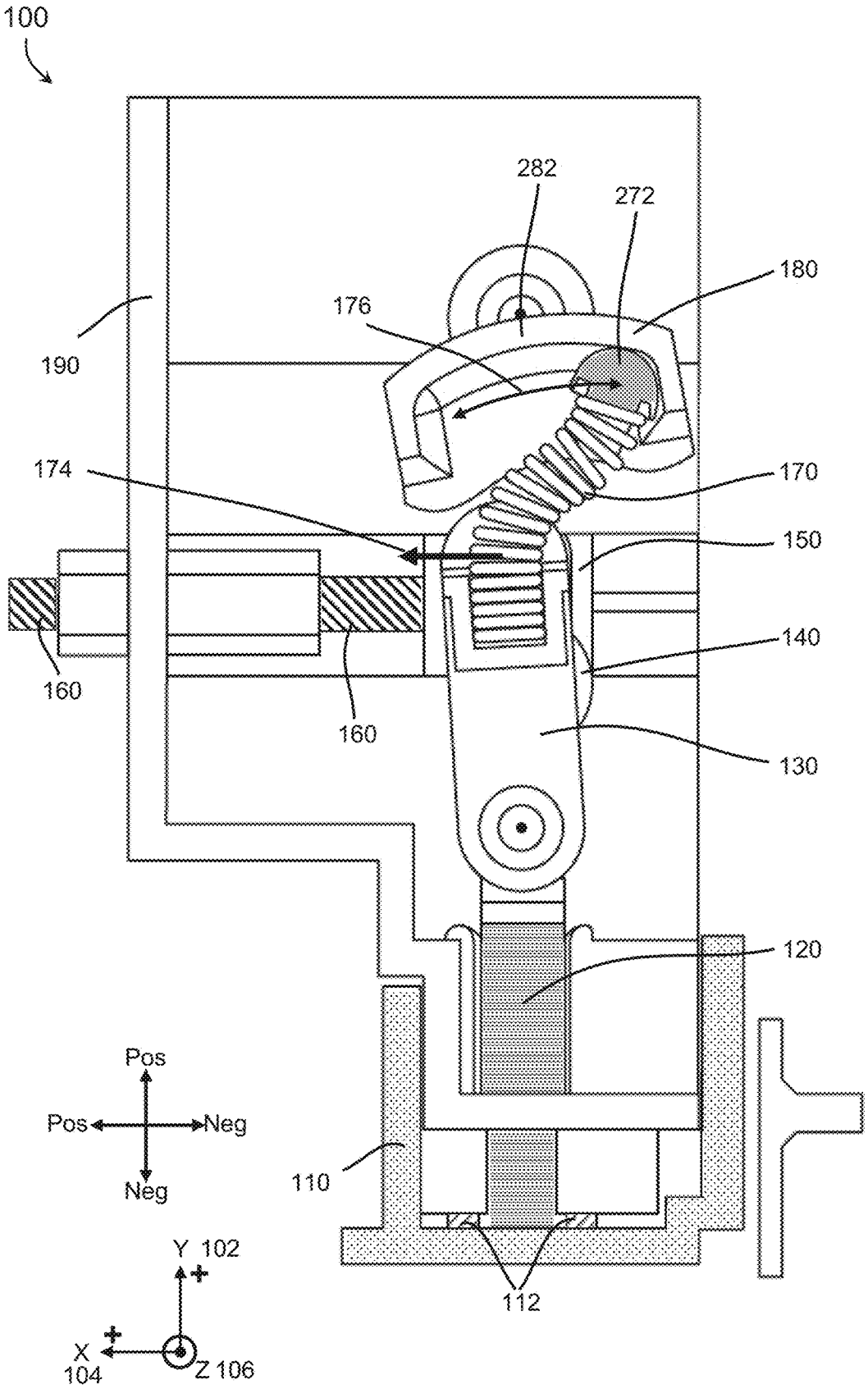
Figure 1E:
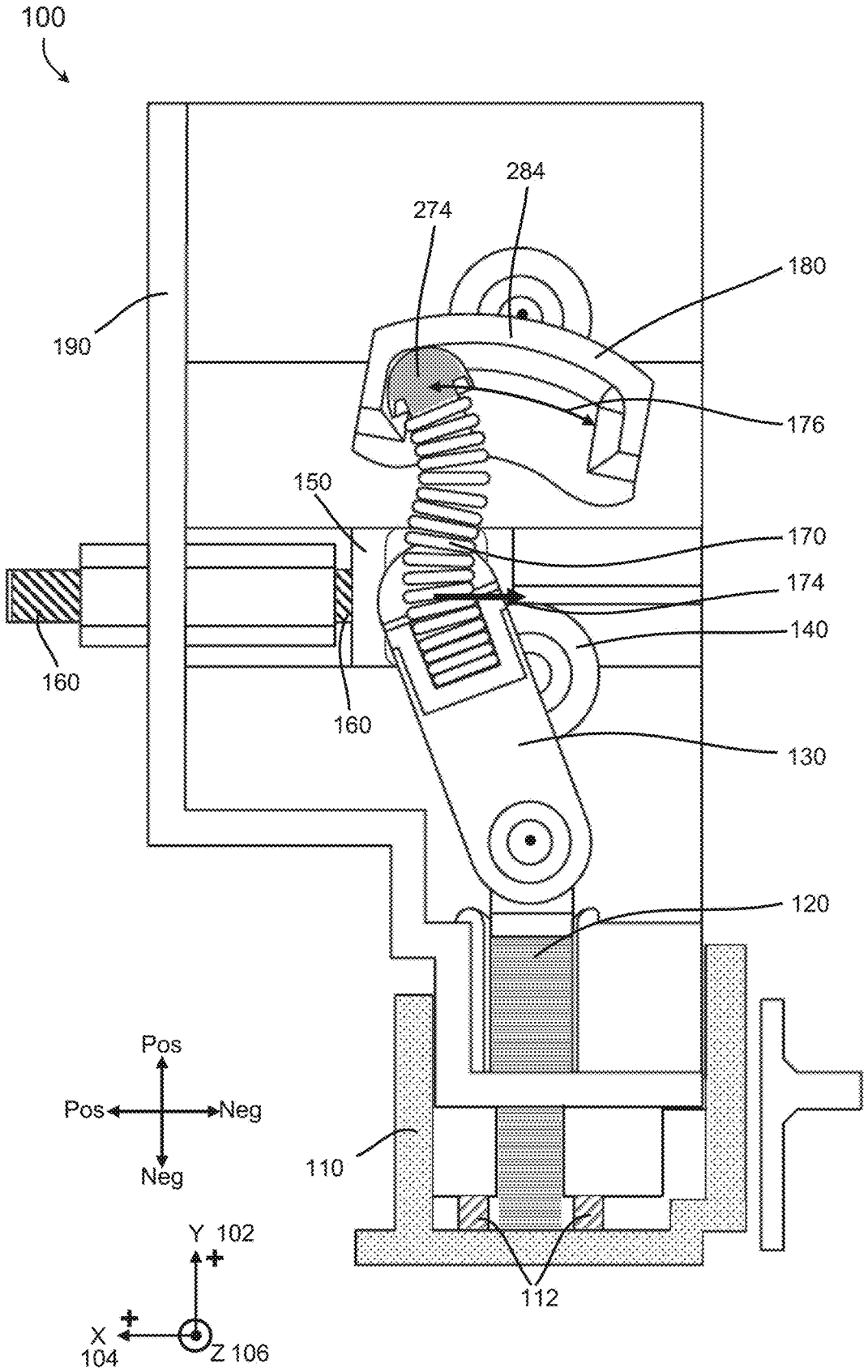

Referring specifically to FIGS. 1D and 1E, the knuckle 172 may function to translate (slide) 176 within the X axis translation and maintain a positive force position 272 and a negative force position 274 within the hat housing 182. The knuckle positive force position 272 may correspond with the hat positive position 282 and the locking pin retracted position while the knuckle negative force position 274 may correspond with the hat negative position 284 and the locking pin extended position.

In one embodiment of the inventive concepts disclosed herein, the buckling spring 170 may be configured for asserting a buckling spring force 174 which acts both positively and negatively along the X axis on the crank end 336 of the rod 130 and therefore, the each of arc end 346 of the crank 140 and the crank pin extension 148 as well. The buckling spring force 174 may function to assist the crank 140 in continuing a desired rotation. As the crank 140 rotates to vertical in either direction, the buckling spring 170 compresses increasing a potential of the buckling spring 170. Depending on which position the knuckle 172 may be will depend on which direction (positive to aid in locking pin extension or negative to aid in locking pin retraction) the buckling spring force 174 may be applied to the rod 130 and crank 140.

In one embodiment of the inventive concepts disclosed herein, the buckling spring 170 may be further configured to reach a compression less than a maximum compression as the crank axis 240 is aligned with the Y axis 102.

Figure 2A:
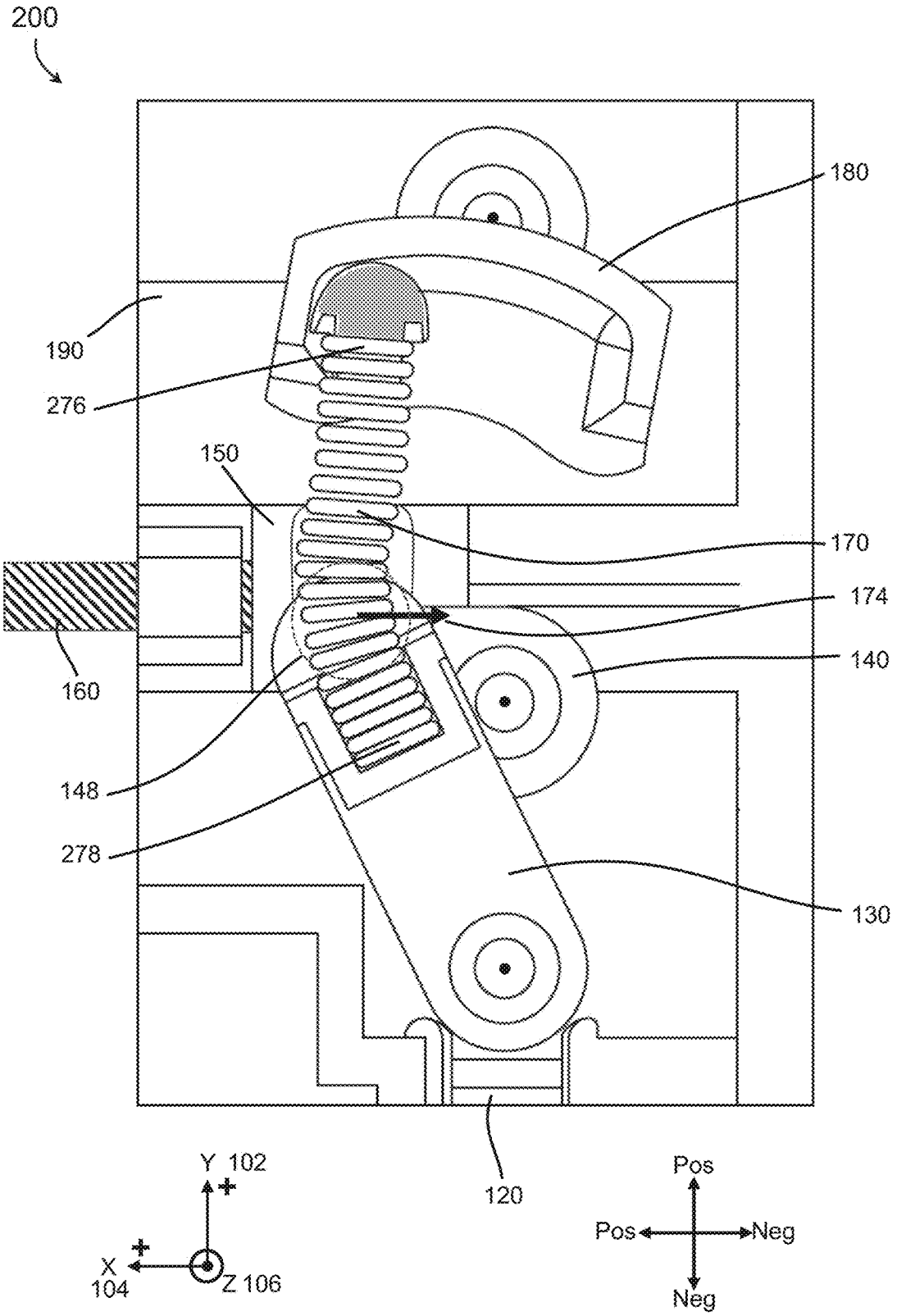
FIGS. 2A-2D are diagrams of a toggle latch device in locking pin retraction in accordance with an embodiment of the inventive concepts disclosed herein.
Figure 2B:
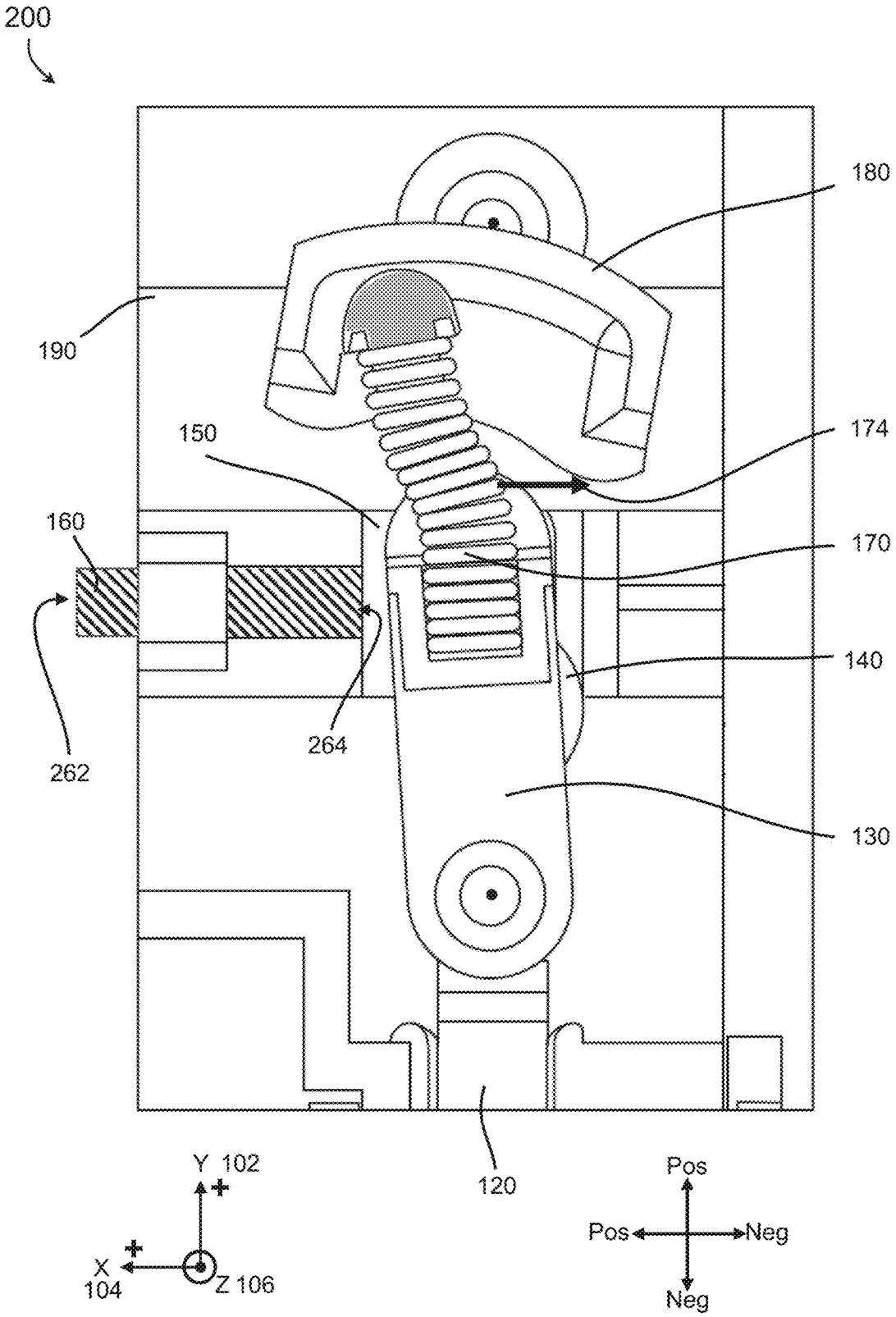
Figure 2C:
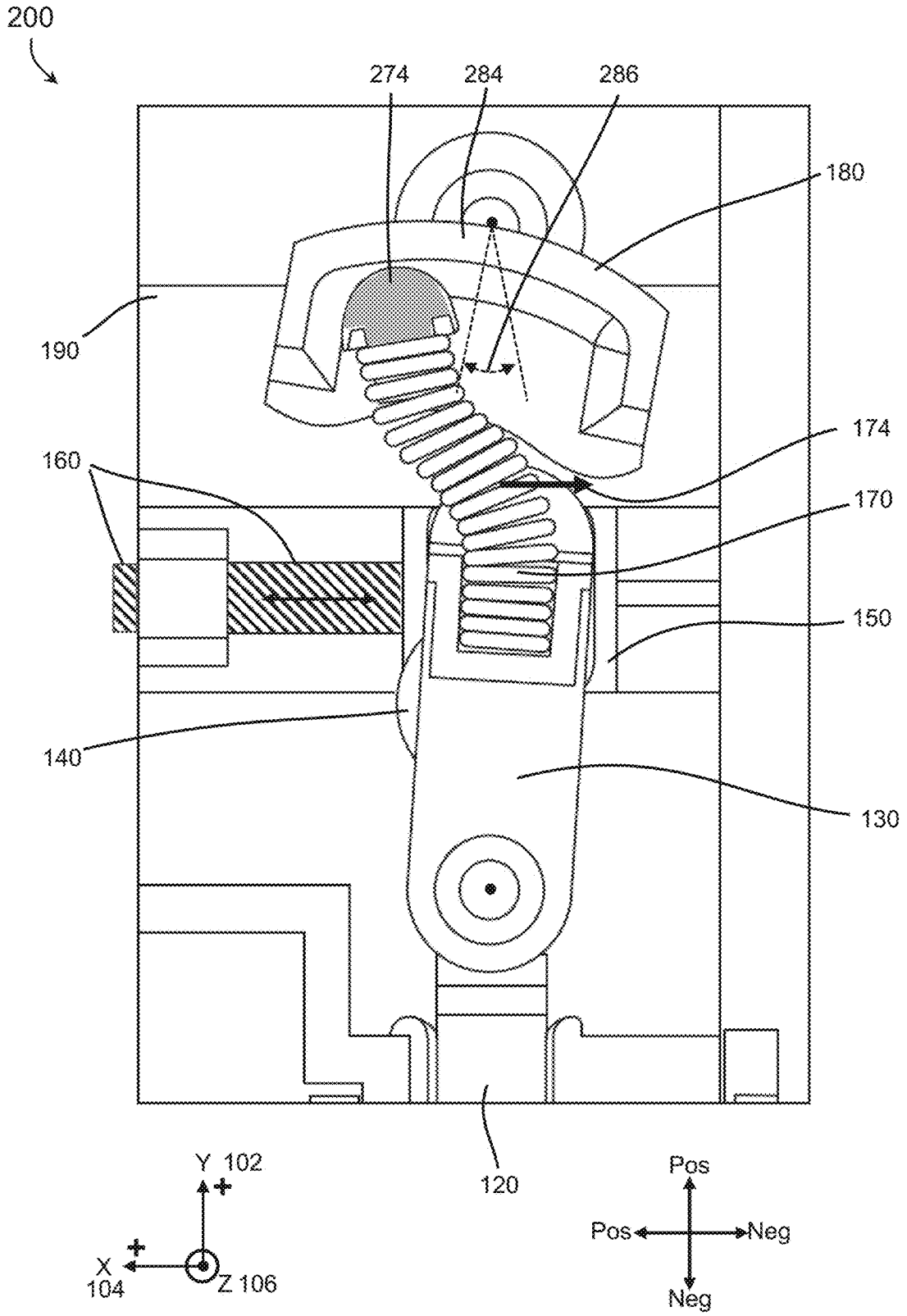
Figure 2D:
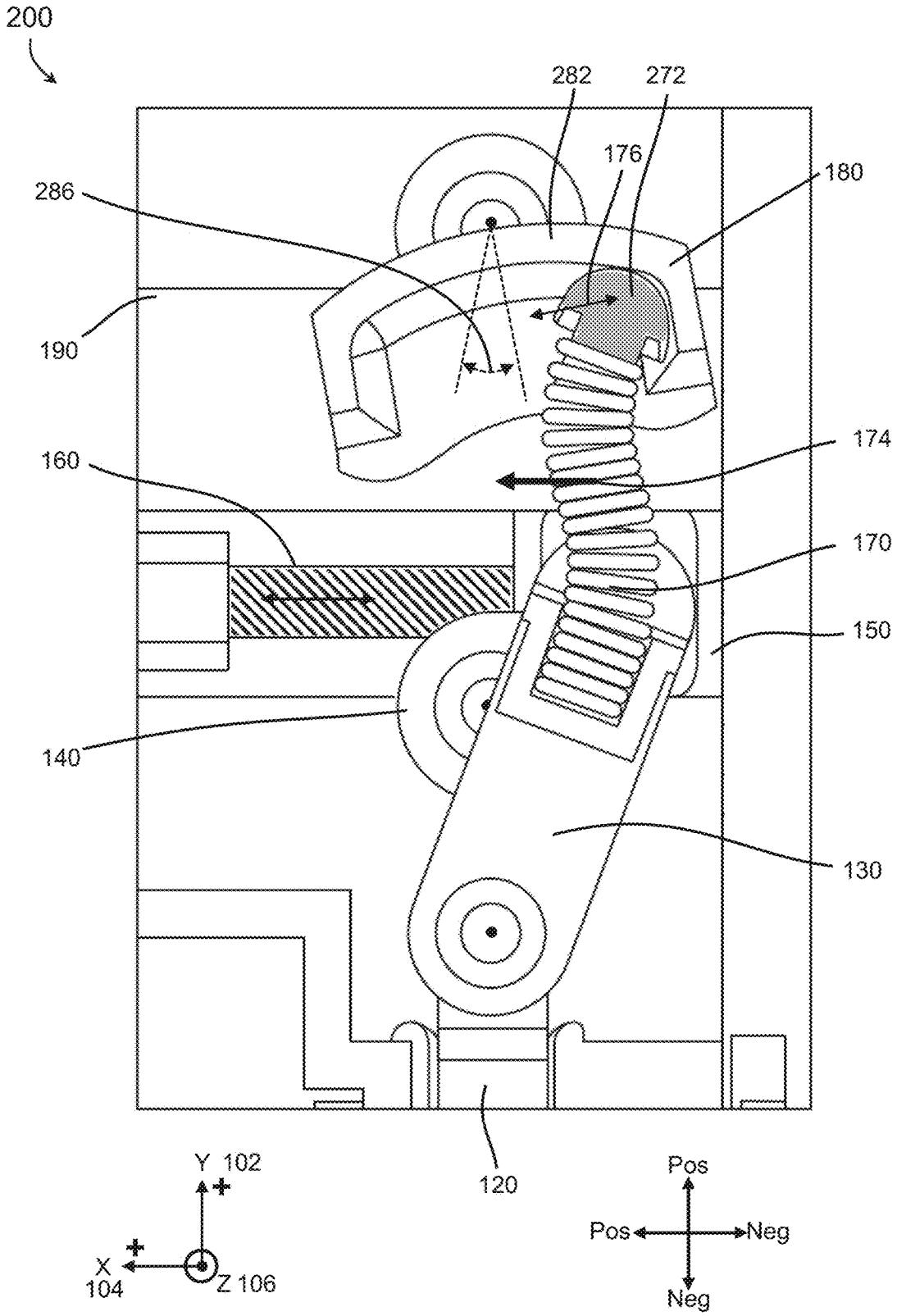

Here, the buckling spring force 174 may be limited to a vector along the X axis and in one of a positive buckling spring force corresponding to 1) the locking pin 160 in transit from the retracted position, 2) the hat 180 in the positive position 282 and 3) the knuckle in the positive force position 272. A negative buckling spring force may correspond to the locking pin 160 in transit from the extended position, the hat 180 in the negative position 284, and the knuckle 172 in the negative force position 274. FIGS. 1C and 2B may detail situations where the buckling spring force 174 may be its greatest with the buckling spring 170 in maximum compression. A positive (FIG. 1C) and negative (FIG. 2B) buckling spring force 174 may function to assist the crank 140 over the center position (FIG. 3C) and continue in the desired direction.

Device Function

In operation, a Y axis push and release of the button 110 causes a positive X axis translation of the locking pin 160 from retraced to extended. A second push and release of the button 110 causes a negative X axis translation of the locking pin 160 from extended to retracted.

While the locking pin 160 may be in the retracted position, a first positive Y axis translation of the button 110 (FIGS. 1B-1C) may cause a rotation of the crank 140 aligning the crank axis 240 with the Y axis 102 positively translating the locking pin 160. Here, a counterclockwise rotation of the crank 140 brings the crank 140 to an over center position aligned with the Y axis. Should the positive buckling spring force 174 not be present, as the button 110 is released, the crank 140 may return to the original position. With the positive buckling spring force 174 present, a first negative translation of the button 110 allows the positive buckling spring force 174 to force the arc end of the crank 140 to positively comply with the positive buckling spring force 174 positively translating the locking pin 160 to the locked position causing the knuckle 172 to slide to the negative force position 274, the knuckle 172 causing the hat 180 to rotate to the negative position 284.

In one embodiment of the inventive concepts disclosed herein, a second positive Y axis 102 translation of the button 110 may cause a clockwise rotation of the crank 140 aligning the crank axis 240 with the Y axis 102 negatively translating the locking pin 160. A second negative Y axis 102 translation of the button allows the negative buckling spring force to force the arc end of the crank to negative comply with the negative buckling spring force negatively translating the locking pin to the retracted position causing the knuckle to slide to the positive force position, the knuckle causing the hat to rotate to the positive position.

In one embodiment of the inventive concepts disclosed herein, some elements of the toggle latch device may be comprised of a high strength plastic material.

FIG. 5

Figure 5:
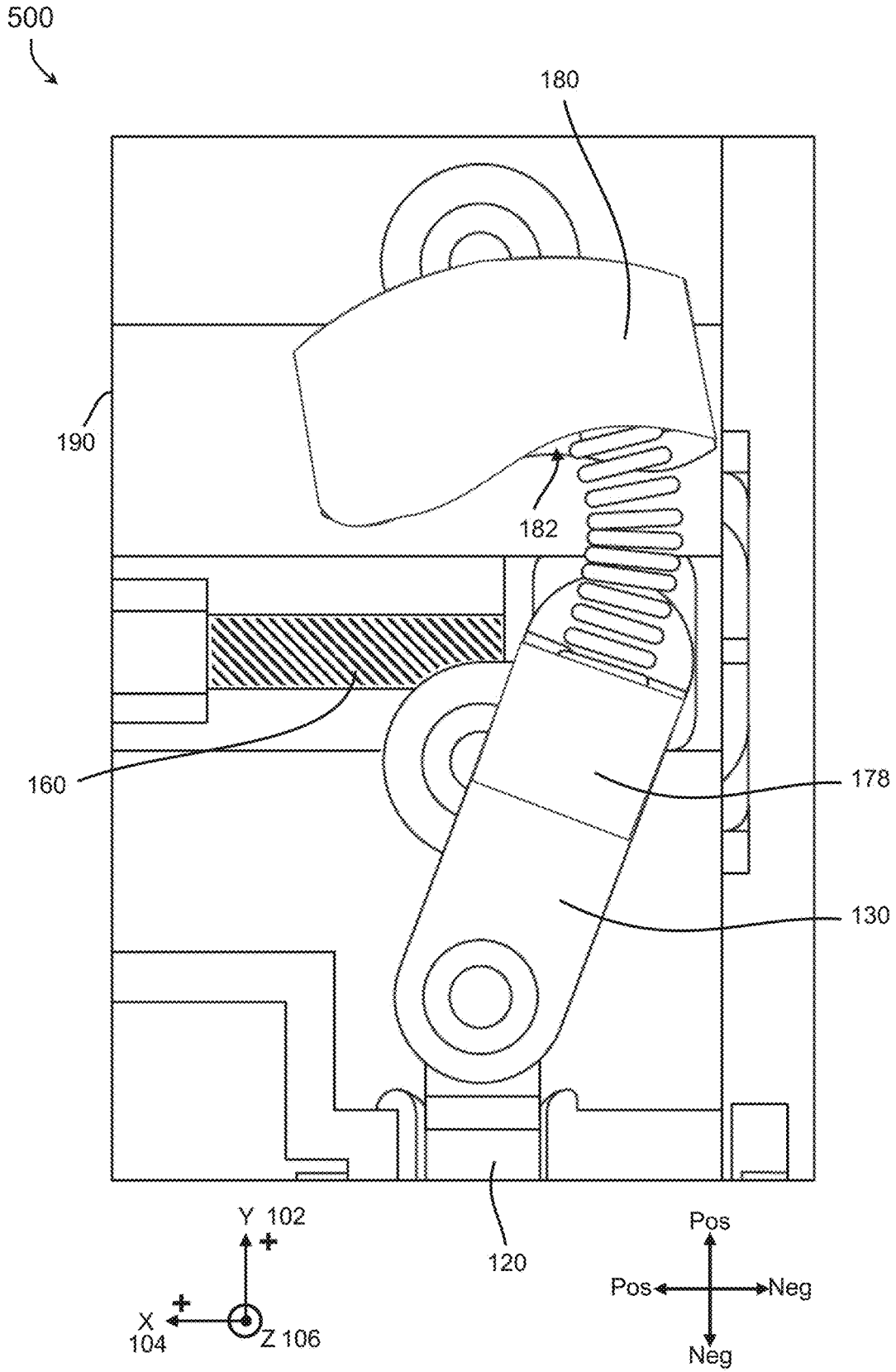
FIG. 5 is a diagram of a front view of the toggle latch device with enclosed spring housings exemplary of one embodiment of the inventive concepts disclosed herein.

Referring now to FIG. 5, a diagram of a front view of the toggle latch device with enclosed spring housings exemplary of one embodiment of the inventive concepts disclosed herein is shown. The enclosed views 500 of the rod spring housing 178 as well as the hat spring housing 182 may indicate enclosures configured for reception of the buckling spring 170.

FIG. 6

Figure 6:
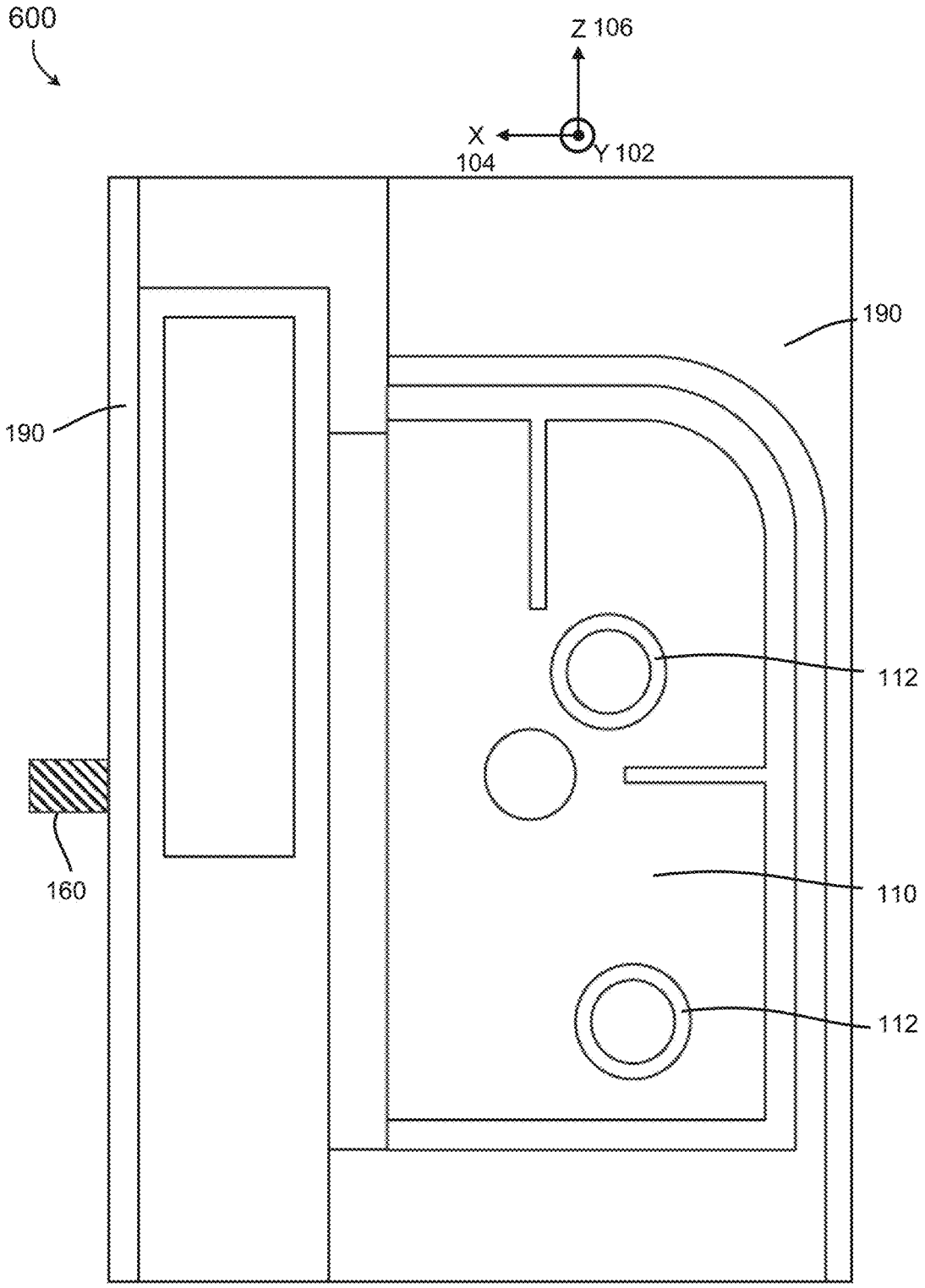
FIG. 6 is a diagram of a bottom view along the Y axis in accordance with one embodiment of the inventive concepts disclosed herein.

Referring now to FIG. 6, a diagram of a bottom view along the Y axis in accordance with one embodiment of the inventive concepts disclosed herein is shown. A bottom view 600 may indicate the button 110 with associated button springs 112.

FIG. 7

Figure 7:
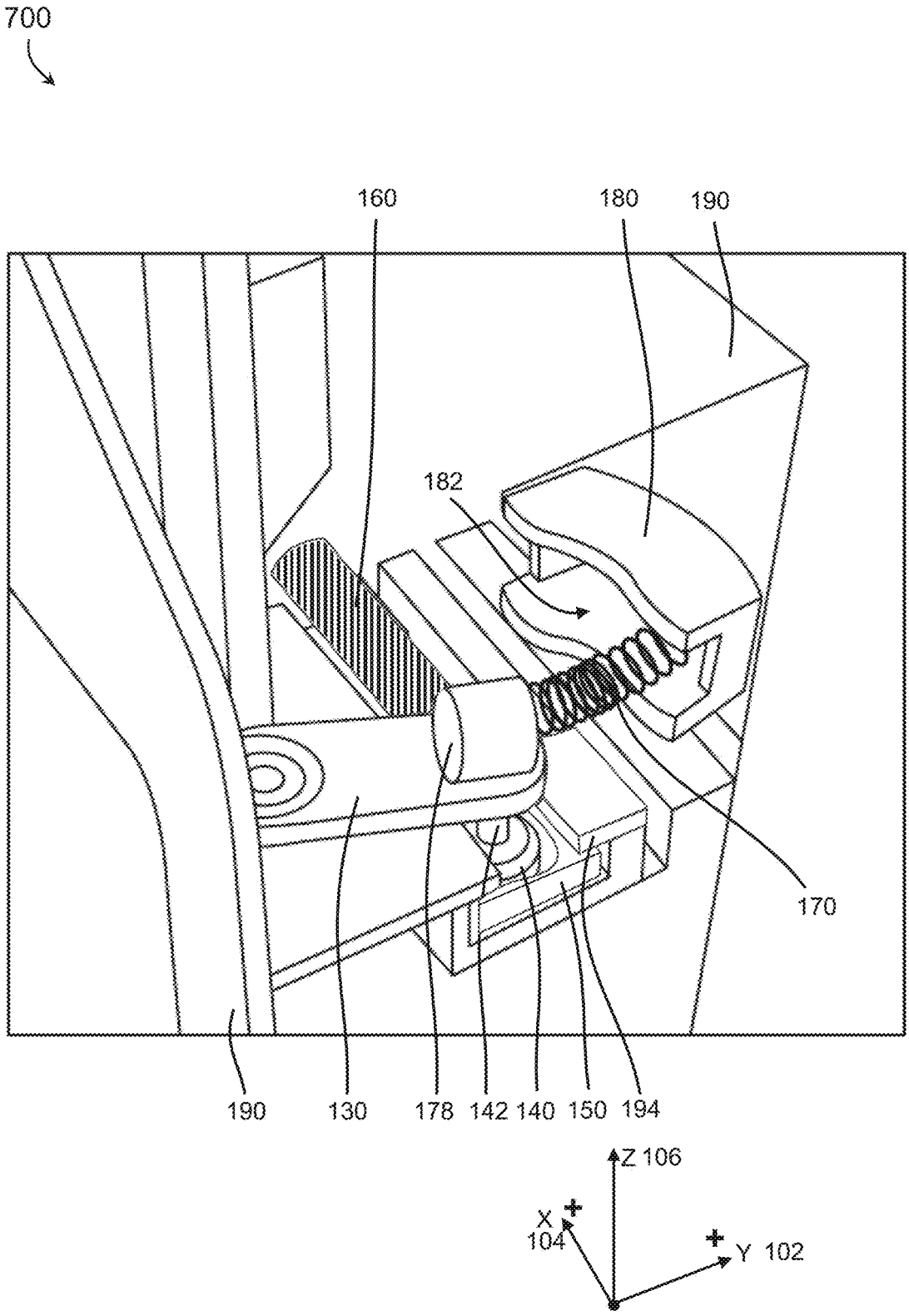
FIG. 7 a diagram of a perspective view associated with one embodiment of the inventive concepts disclosed herein.

Referring now to FIG. 7, a diagram of a perspective view associated with one embodiment of the inventive concepts disclosed herein is shown. The perspective view 700 may offer an alternate view of some of the elements. Notably, the slide 150 with an exemplary cutout to reveal the crank 140 and each of the spring housings which receive the buckling spring 170.

Contemplated herein, the toggle latch device 100 may be efficiently incorporated within a frame of an oven wherein the oven door may include an orifice aligning with the locking pin 160. Should a user wish to lock the oven door, the user may close the oven door with one hand, and actuate the button 110 with the same hand or other hand. Specifically, the toggle latch device 100 may be specifically configured for installation and use on board an aircraft within an aircraft oven.

An additional incorporation may include a dead bolt type of lock offering a single press of the button 110 to lock and a single press of the button 110 to unlock. A toggle latch device incorporated within a vehicle skin may offer less aerodynamic skin friction drag compared with traditional door handles. Here, the button 110 may maintain a flush position relative to a vehicle skin housing.

Users with physical and/or mental difficulties may find particular usefulness of the toggle latch device. Alternate embodiments of the toggle latch device 100 may find successful incorporation within additional types of systems.

In addition, as an aesthetic appearance of the button 110 may be beneficial to a controlled device within which the toggle latch device 200 may be functional, the button 110 may remain flush with the surface of the controlled device in both a locked and unlocked position of the locking pin 160. Therefore, the flush mount of the button 110 may allow the button 110 to be an external design feature of the controlled device despite the position of the locking pin 160.

CONCLUSION

As will be appreciated from the above description, embodiments of the inventive concepts disclosed herein may provide a novel solution to a simple locking device operated via a single actuation of a button.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. A toggle latch device, comprising:

a housing having a Y axis and an X axis, the X axis normal to the Y axis;

a locking pin configured for an X axis translation within a pin conduit within the housing, the locking pin having a locked position extending from the housing and a retracted position within the housing, the locking pin having a locking end extendable from the housing and a slide end opposite the locking end within the housing;

a button configured for a Y axis translation within a button conduit within the housing, the button having a flush position flush with the housing and an activation position within the housing, a motion of the button from the flush position to the activation position within the Y axis translation;

at least one button spring biased for extension of the button to the flush position;

a piston having a button end and a rod end, the button end rigidly coupled with the button, the piston limited to the Y axis translation within a piston conduit within the housing;

a rod having a piston end and a crank end, the piston end rotationally coupled with the rod end of the piston via a wrist pin, the crank end configured with a rod spring housing;

a crank having an arc end and a shaft end, the arc end rotationally coupled with the rod on the crank end of the rod via a crank pin, the shaft end rotationally coupled with the housing via a shaft, the crank configured for a crank rotation about the shaft;

the crank having a crank axis aligning the shaft and the crank pin, the rod having a rod axis aligning the wrist pin and the crank pin;

a slide rigidly coupled with the locking pin, the slide having a crank pin extension channel, the slide configured for the X axis translation within a slide channel within the housing;

the crank pin rotationally coupling each of the rod, the crank, and a crank pin extension extending within the crank pin extension channel, the crank pin extension slidably coupled with the crank pin extension channel, the crank pin extension configured for the Y axis translation within the crank pin extension channel;

a hat rotatably coupled with the housing via a hat pin, the hat having a hat spring housing, the hat limited in rotation about the hat pin, the hat having a positive position corresponding to the locking pin retracted position and a negative position corresponding to the locking pin locked position;

a buckling spring having a fixed end and a hat end, the buckling spring rigidly coupled with the rod spring housing on the fixed end, the buckling spring including a knuckle rigidly coupled with the hat end, the knuckle slidably coupled with and inserted within the hat spring housing, the knuckle having a positive force position and a negative force position within the hat housing, the buckling spring configured for asserting a buckling spring force on the crank end of the rod, the buckling spring force along the X axis and one of: a positive buckling spring force corresponding to the locking pin retracted position and a negative buckling spring force corresponding to the locking pin extended position;

wherein, with the locking pin in the retracted position:

a first positive translation of the button causes a rotation of the crank aligning the crank axis with the Y axis positively translating the locking pin; and a first negative translation of the button allows the positive buckling spring force to force the arc end of the crank to positively comply with the positive buckling spring force positively translating the locking pin to the locked position causing the knuckle to slide to the negative force position, the knuckle causing the hat to rotate to the negative position;

a second positive translation of the button causes the rotation of the crank aligning the crank axis with the Y axis negatively translating the locking pin; and a second negative translation of the button allows the negative buckling spring force to force the arc end of the crank to negative comply with the negative buckling spring force negatively translating the locking pin to the retracted position causing the knuckle to slide to the positive force position, the knuckle causing the hat to rotate to the positive position.

2. The toggle latch device of claim 1, wherein the housing, the locking pin, the rod, and the crank are each comprised of a high strength material.

3. The toggle latch device of claim 1, wherein the slide channel, the knuckle, and the hat spring housing are of a friction reducing material.

4. The toggle latch device of claim 1, wherein the toggle latch device is specifically configured for use onboard an aircraft within an aircraft oven.

5. The toggle latch device of claim 1, wherein an angular rotation of the rod is limited to approximately 50 degrees.

6. The toggle latch device of claim 1, wherein an angular rotation of the crank is limited to approximately 147 degrees.

7. The toggle latch device of claim 1, wherein an angular rotation of the hat is limited to approximately 20 degrees.

8. The toggle latch device of claim 1, wherein the Y axis translation of the button is approximately equal to the Y axis translation of the crank pin.

9. The toggle latch device of claim 1, wherein a size of the crank pin extension is slightly smaller than a size of the crank pin extension channel.

10. The toggle latch device of claim 1, wherein the button is further configured to maintain the flush position relative to a vehicle skin housing.

11. The toggle latch device of claim 1, wherein approximately four times the Y axis translation of the button is approximately equal to the X axis translation of the locking pin.

12. The toggle latch device of claim 1, wherein the buckling spring is further configured to reach a compression less than a maximum compression as the crank axis is aligned with the Y axis.

13. The toggle latch device of claim 1, wherein the hat maintains the positive position until the locking pin reaches a position approximately equal with the locked position.

14. The toggle latch device of claim 1, wherein the hat maintains the negative position until the locking pin reaches a position approximately equal with the retracted position.

* * * * *